United States Patent [19]

Sigafoose

[11] 4,386,500

[45] Jun. 7, 1983

[54] WATER HEATER HEAT EXCHANGE APPARATUS, KIT, AND METHOD OF INSTALLATION

[76] Inventor: Boyd Sigafoose, Rte. 2, Box 350, Century, Fla. 32535

[21] Appl. No.: 249,825

[22] Filed: Apr. 1, 1981

[51] Int. Cl.[3] ..... F25B 7/00

[52] U.S. Cl. ..... 62/79; 62/238.6; 62/324.5

[58] Field of Search ..... 62/238.6, 324.5, 79; 237/2 B

[56] References Cited

U.S. PATENT DOCUMENTS

| | | | |
|---|---|---|---|
| 2,125,842 | 8/1938 | Eggleston | 62/238.6 |
| 2,575,325 | 11/1951 | Ambrose et al. | 62/238.6 X |
| 2,619,326 | 11/1952 | McLenegan | 62/238.6 |
| 3,301,002 | 1/1967 | McGrath | 62/238.6 |
| 4,073,285 | 2/1978 | Wendel | 126/417 |
| 4,098,092 | 7/1978 | Singh | 62/238.6 |
| 4,173,872 | 11/1979 | Amthor, Jr. | 62/238.6 |
| 4,226,606 | 10/1980 | Yaeger et al. | 62/238.6 |
| 4,293,323 | 10/1981 | Cohen | 62/238.6 |
| 4,330,309 | 5/1982 | Robinson, Jr. | 62/238.6 X |

OTHER PUBLICATIONS

Powell, E., "New, Energy-Saving Heat Pump Water Heater", Popular Science-pp. 49 and 50, Apr. 1980.

Healy, C. T., "Water Heating by Recovery of Rejected Heat from Heat Pumps", ASHRAE Journal (Apr., 1965), pp. 68-74.

*Primary Examiner*—Lloyd L. King

*Attorney, Agent, or Firm*—Kenway & Jenney

[57] ABSTRACT

A heat saving conversion unit for hot water heaters of conventional type consisting of a heat exchanger attachment together with appropriate connecting apparatus provided in kit form, and the method of use thereof, which includes a stainless steel outer casing provided with inlet and outlet water connections and a heat exchange tubing structure consisting of an outer tubing of stainless steel and an inner structure of soft copper for receiving hot refrigerant gases therethrough to extract the normally wasted heat therefrom and in turn heat the water passing thereby. A feature is in the connection of this attachment to the conventional drain plug opening and popoff valve openings of the conventional type hot water heater. Furthermore, an extension tube is contained with the kit for insertion into the popoff valve opening of the tank so that the hot water from the heat exchanger attachment exits into the hot water tank lower than the upper electric heating element when the kit is used with an electric type hot water heater.

5 Claims, 10 Drawing Figures

WATER HEATER HEAT EXCHANGE APPARATUS, KIT, AND METHOD OF INSTALLATION

BACKGROUND OF THE INVENTION

1. Field of the Invention

This invention relates to apparatus for use with conventional type hot water heaters in order to use heat which is normally wasted from residential or commercial refrigeration, air conditioning, or heat pump systems.

2. Description of the Prior Art

A number of known prior art devices are available which are for the purpose of utilizing heat from air conditioning and refrigeration systems which otherwise would be lost or wasted. Various methods and apparatus are employed to utilize this heat with hot water tanks. However, known type prior art devices are rather complicated, quite expensive, and do not permit the ordinary homeowner or small business operator to efficiently and inexpensively convert existing hot water heaters presently in use to use wasted heat.

Some prior art devices which may be pertinent to this invention are as follows:

U.S. Pat. No. 4,073,285 to Wendel, issued Feb. 14, 1978

U.S. Pat. No. 4,098,092 to Singh, issued July 4, 1978

U.S. Pat. No. 4,173,872 to Amthor, Jr., issued Nov. 13, 1979

None of these prior art devices offers the new and unique advantages of the present invention. For example, the patent to Wendel is a system which is relatively expensive and more complicated than that of the present invention. The system disclosed in this patent requires numerous valves and at least one pump in order to function properly. The present invention does not require any pumps and thus the cost thereof is substantially reduced over systems which do require pumps.

The Singh patent requires the use of an extra water tank and merely preheats the water to the conventional hot water tank. Thus, this system does not function by heating the water directly in the existing hot water tank as in the present invention.

The Amthor, Jr. patent, while heating the water directly in the hot water tank, requires relatively complicated heat exchange structure and a much more elaborate overall system than that of the present invention.

It is not believed that any of the aforedescribed prior art patents, nor any other prior art material known to applicant, offers the new and unique features of the present invention.

SUMMARY OF THE INVENTION

An object of the present invention is to provide conversion structure for use by individuals for the purpose of capturing otherwise wasted heat from air conditioners, refrigeration systems, heat pumps, and the like, and for installation with conventional type hot water heaters for the purpose of using the otherwise wasted heat and thereby reduce the actual energy input required for the hot water heater.

A further object of the present invention is to provide conversion equipment and structure as needed for efficient energy conversion of waste heat to heat hot water which equipment is provided in kit form for easy installation by the average homeowner. The kit is supplied in a container having all of the required elements needed for such conversion and installation with existing heating and cooling systems as common in the average house.

A still further object of the present invention is in the method of installing and converting of conventional heating/cooling and hot water systems for the purpose of utilizing otherwise wasted heat.

The present invention includes a simple kit combination which may be provided to existing users of hot water heaters and heating/cooling systems for conversion of their present components to more efficient use without a lot of expensive additional equipment. Furthermore, the kit of the present invention permits ready and easy installation of the component elements thereof with existing conventional hot water heaters whether of the electric, gas, or oil fired type.

The present invention also includes the use of a double heat exchanger structural unit for homes having two split air conditioning units, and/or combination heating and cooling structure commonly known as heat pump systems. In the case of commercial use, a walk-in type refrigeration/cooler system for the commercial establishment together with the air conditioning system for the establishment may be both hooked up so as to heat the usual amount of hot water needed by such a commercial establishment by use of the double heat exchanger structure of the present invention.

Another important feature of the present invention is in the method of conversion of the conventional hot water system to more efficient usage thereof. In many known type devices extra holes and connecting points must be provided or made in the hot water system. This is detrimental in that many of the presently used hot water tanks are glass lined, and the addition of additional apertures therein oftentimes fractures this lining, or otherwise damages it. This of course permits rust to form on the tank itself once the glass lining is cracked or fractured, thus quickly shortening the overall life of the hot water tank.

The present invention uses apparatus and method of installation which eliminates this possibility. This is effected by connecting the heat exchanger unit, whether single or double type, to the existing drain aperture of a conventional type hot water tank, and to the existing popoff valve opening at the top of the tank. Another important feature is in the addition of a flanged discharge tube which extends 18 to 24 inches into the tank so that the exit of the tube will be a short distance below the upper heating element in the case of electric hot water heaters. This greatly increases the overall efficiency of operation of this system with electric hot water heaters over that of some known type systems.

A further very important feature of the present invention is in providing all the necessary structural components in a container or package, i.e. in kit form for easy distribution and sale to the consumer. All of the necessary connecting hardware, which can be purchased relatively inexpensively in quantity but as single elements are both relatively expensive and sometimes hard to obtain in small quantities, are included in the kit. Of course, suitable instructions for installation of the components are a part of the kit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
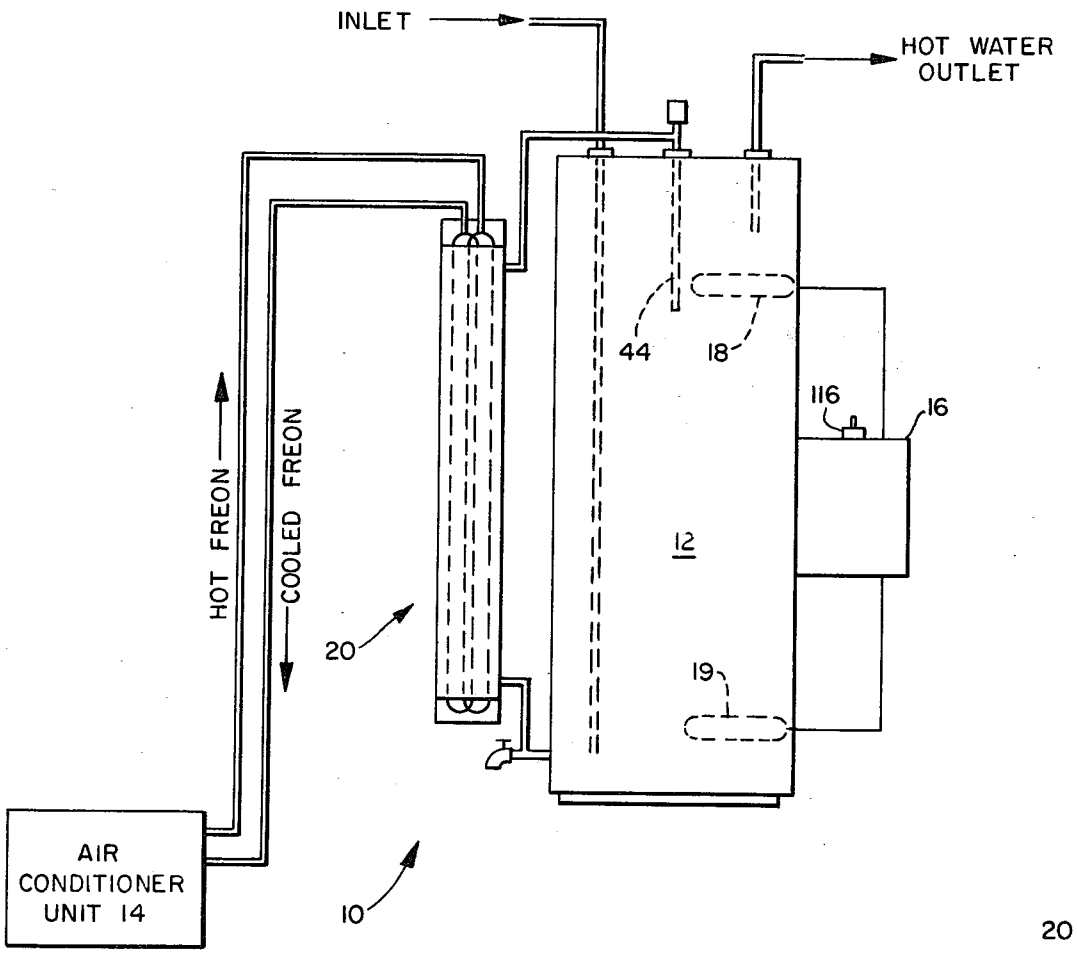
FIG. 1 is a schematic type sketch of the present invention in use with a conventional air conditioning or refrigeration system and an electric hot water heater.

Referring to FIG. 1 of the drawings, reference numeral 10 indicates in general the combination of the present invention with a conventional type refrigeration and/or air conditioner unit 14 and a conventional type electrical hot water heater 12. The conversion heat exchanger unit of the present invention is indicated in general by a reference numeral 20. Also shown in FIG. 1 is a panel 16 having appropriate switches and thermostats normally provided with the electric hot water tank for connecting the upper and lower electric heating elements 18 and 19 respectively to a source of electric power. This panel will permit a user of the overall system to switch one or both of the electric heating elements 18 and 19 on and off during the retrieving of the normally waste heat by the heat exchanger unit. One or more switches 116 can be added to this panel. Also appropriate thermostats usually are incorporated in this panel for association with the hot water tank at appropriate positions therealong for controlling the switching automatically when so desired. Also shown in FIG. 1 is the input discharge tube 44 for the hot water input to the hot water tank from the heat exchanger unit. This tube extends into the tank 18 to 24 inches (45 to 60 centimeters) so that the exit or lower end thereof will be at least three inches below the upper electric heating element 18. Since tube 44 is preferably made of PVC, the straight end (opposite the flared top end) may be cut off during installation to shorten the tube, if necessary, to achieve this desired exit opening position about 3 inches (7.5 cm) below the upper electric heating element 18. This is another important feature of the present invention.

Figure 2:
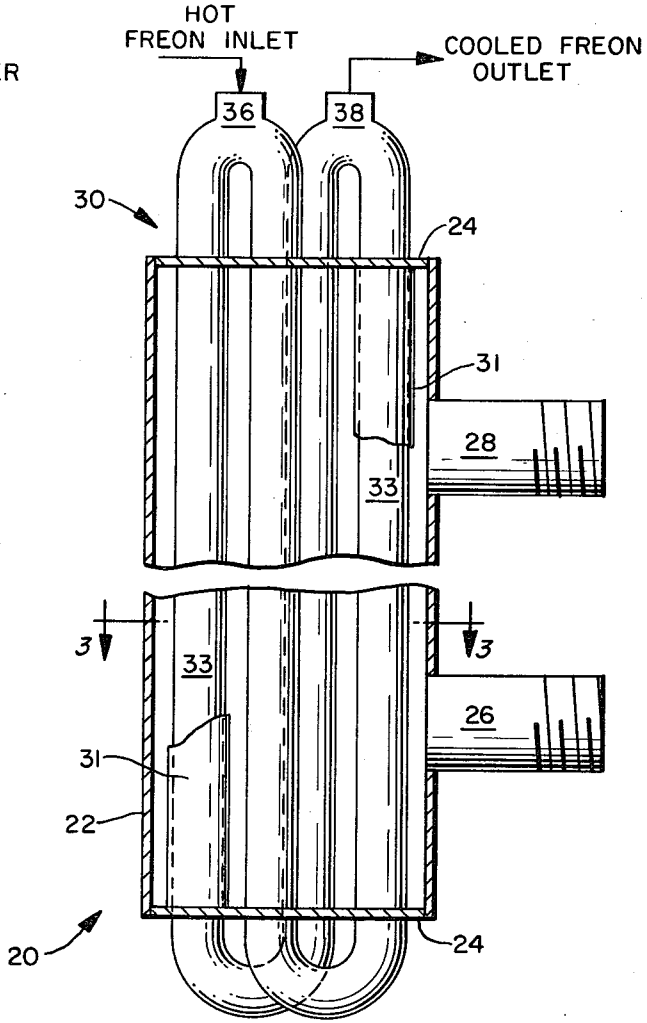
FIG. 2 is an elevational view, partly in cross-section, showing one embodiment of the heat exchanger unit of the present invention.
Figure 3:
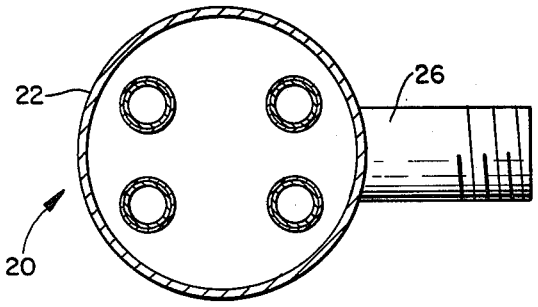
FIG. 3 is a cross-sectional view taken substantially along lines 3—3 of FIG. 2.
Figure 4:
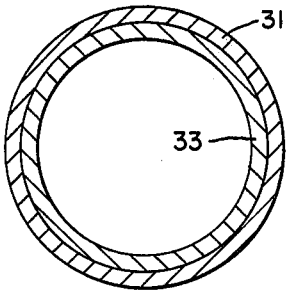
FIG. 4 is an enlarged cross-sectional view of one of the heat exchanger tube elements of FIG. 3.

Looking at FIGS. 2–4, the heat exchanger unit of the preferred embodiment of the present invention is shown in greater detail. FIG. 2 is a compressed elevational view of a heat exchanger unit per se of the present invention. An outer casing 22 for the heat exchanger is preferably made of a stainless steel casing approximately 3½ inches in outer diameter and either 36 inches or 48 inches long. The respective ends of this casing are closed by end disks 24. Each of the disks 24 is provided with appropriate apertures therein for passage therethrough of the actual heat exchange tubes of the unit. These tubes are preferably formed with the double connected U configuration shown. An inlet opening stub 36 is provided at one upper U-portion and an outlet opening stub 38 at the other upper U-portion. These opening stubs permit the flow of the refrigeration or air conditioning/heat pump gases through the heat exchanger tubing. The input stub 36 receives hot freon or other refrigeration/air conditioning gases which pass through the inner portions of the tubing and exit at a much cooler temperature from the exit stub 38. The casing 22 is provided with inlet and outlet water taps 26 and 28 for connection to the conventional hot water tank as described hereafter. Each completed unit weighs approximately 20 to 24 lbs.

As shown in FIG. 4, each heat exchanger tube structure is preferably made of approximately one-half inch outer diameter soft copper refrigeration tubing contained within a ⅜-inch seamless stainless steel outer tubing having approximately an 0.035 inch wall. During manufacture of this tubing the soft copper inner tubing is normally flared to approximately 0.050 inch over size and thus through this process is expanded so as to have good heat conducting contact with the inner surface of the stainless steel tubing. It has been found in actual practice that a tapered roller bearing element attached to the end of a long rod by welding or the like can be used to pass through the inner copper tubing to expand same into proper heat conducting relationship with the outer stainless steel tubing. Of course, other types of metal forming methods and procedures may be used for obtaining the good heat transfer contact between the inner core of copper and the outer tubing of stainless steel. Of course, it is important to have very good contact between the two metals to provide maximum heat transfer while eliminating the need for any additional thermal conductive material therebetween. It is also very important that both the copper and steel metals be used so that the freon gas is always doubly separated by the two metals from the hot water tank water. Oftentimes people use water from the hot water tank for drinking purposes and the like, and to avoid any possible contamination or ill effects from freon gas contamination, this double tubing separation is extremely important.

Figure 5:
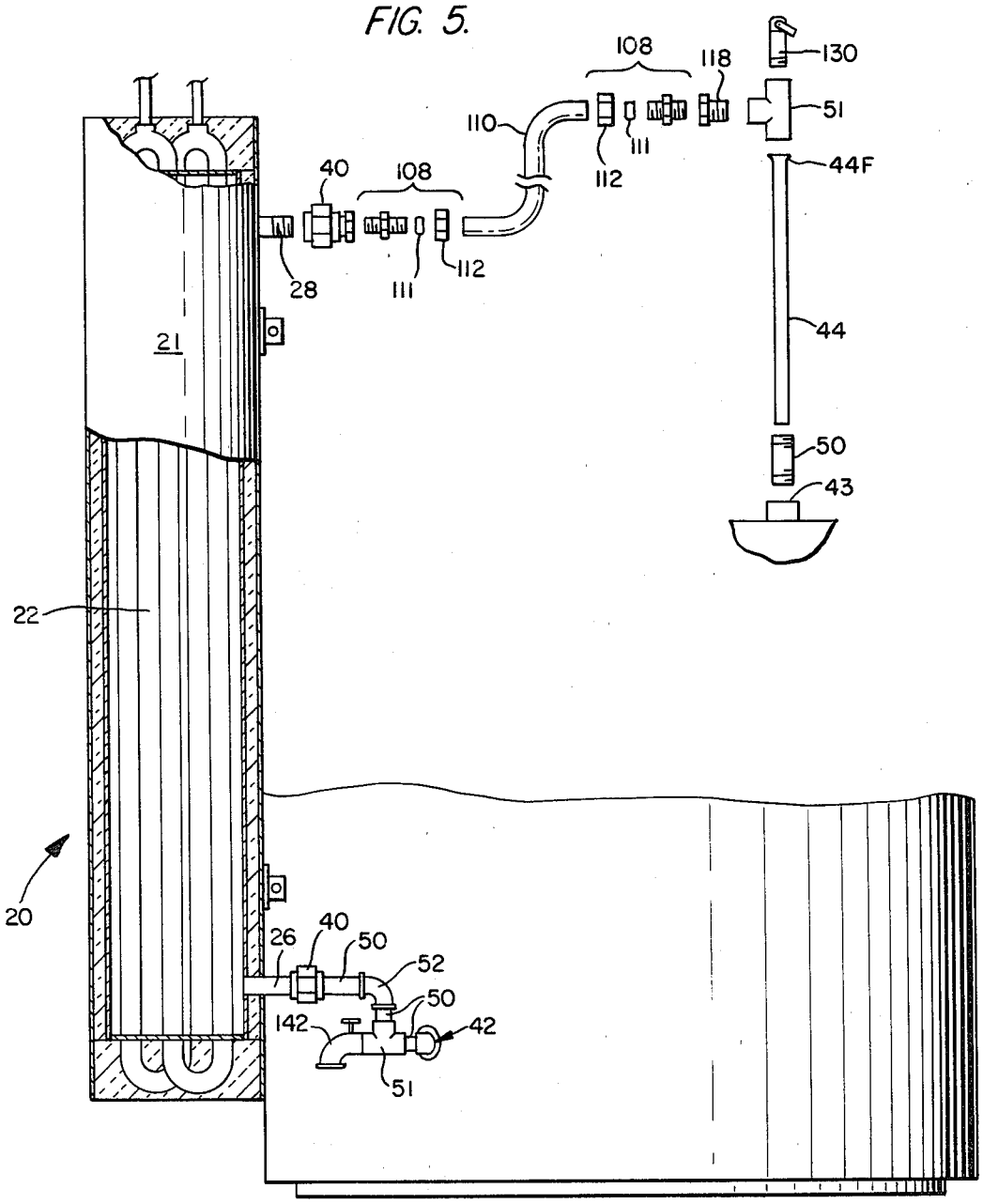
FIG. 5 is a schematic elevational view of a heat exchanger unit of the present invention with attaching structure for connecting it to and supporting it from a conventional type hot water heater.

Looking at FIG. 5, a single heat exchanger element of the preferred embodiment is shown with the preferred connections to a conventional hot water tank. The connecting elements and method of installing the heat exchanger element per se to the hot water tank is also an important feature of the present invention. As described above, each heat exchanger unit weighs approximately 20–24 lbs. and has an outer diameter of approximately 3½ inches (8.75 centimeters), and is either 36 inches (70 centimeters) long or 48 inches (120 centimeters) long. It has been found that either one or the other of these lengths will be suitable for all typical conversions.

Since each heat exchanger unit weighs approximately 24 lbs. or less, it has also been discovered that the lower plumbing connection of the unit to the hot water tank, if made of galvanized piping, can be sufficient to support the weight of the heat exchanger unit without any other substantial support structure needed. This is very important, both from a structural, as well as a time-saving, standpoint.

As shown in FIG. 5, the lower water stub 26 has a galvanized coupling unit 40 attached thereto which is used to connect and support the heat exchange unit from and by the lower drain valve opening of the hot water tank. This drain valve opening 42 normally has the drain valve 142 extending therefrom. During the installation of the conversion unit, this drain valve is unscrewed and a short galvanized nipple 50 screwed into opening 42. Then a galvanized Tee 51 is screwed onto the outer end of the nipple. Then, the drain valve 142 is screwed into the longitudinal end of the Tee 51 and second short nipple 50 screwed into the stem portion of the Tee. Onto the second nipple a galvanized elbow 52 is fastened and then by means of a third nipple 50 an appropriate connection made to the coupling 40. Of course, if slightly more length is required, or repositioning of the unit 22 is necessary, the drain valve could be screwed into the stem portion of the Tee and the connections to the cold water inlet stub 26 of the heat exchanger unit made with just a nipple 50 and a coupling 40, or the like. The described connecting components supplied with the kit are more than sufficient to connect and attach the heat exchange unit to the hot water tank by means of the galvanized fittings and thus form and provide the necessary support for the unit 22.

After the lower supporting connection is made as above, then the upper hot water outlet stub 28 is connected to the top of the tank by means of bendable copper tubing 110. Another galvanized coupling 40 and a copper tubing-to-galvanized adaptor 108 having a compression sleeve 111 and nut 112 therewith are used for attaching one end of the piece of copper tubing (2 to 3 feet long) to the upper stub 28 of the heat exchanger unit. The other end of the copper tubing is connected by means of another copper tubing-to-galvanized adaptor fitting, and a suitable reducing bushing 118 (if needed) to another galvanized Tee 51. This upper Tee is used for connection to the tank at the top opening port 43 as provided for the popoff valve. This popoff valve 130 which is already in place with the hot water tank, is removed from opening 43, and another short nipple 50 screwed into the opening 43. The upper Tee 51 is in turn screwed onto this nipple, but before doing so the discharge pipe 44 is dropped into the tank. Another feature of this invention is that the flange portion 44F of the discharge tube is large enough to rest upon the upper edge of the nipple and yet still permit the galvanized Tee 51 to be screwed onto the nipple. The popoff valve 130 is then screwed into the remaining end of the Tee 51. Of course, depending on the overall size and height of the hot water tank, the flexible and bendable copper tubing 110 can be easily made to conform to the required size, and this upper connection will now support the upper end of unit 22 against lateral movement.

After the heat exchanger unit is thus operationally as well as physically secured to the hot water tank, then the piece of two to three-inch thick insulation is wrapped around the outside of the heat exchanger unit, after which the outer sheet metal cover 21 having the projecting attachment strips 23 formed therewith is placed over the insulation, and then the cover secured to the outer cover of the hot water tank. This outer cover of the tank is normally thin sheet metal and can be easily tapped or drilled to receive sheet metal screws through the holes 25 provided in the attaching strips 23 to secure the cover over the insulation covered heat exchange unit, and will provide a pleasing appearance for the outside of the conversion unit after the physical installation thereof.

Also, as previously indicated, it is very important during the initial installation, especially if used with a hot water heater of the electric type, that the discharge tube 44 be cut to the proper length so that it will extend approximately three inches (7.5 centimeters) below the upper heating element. In the case of a gas- or oil-fired hot water heater, the tube 44 should be approximately the same length for maximum desirable benefits from this invention, but in these cases the length is less critical than in the case of electric hot water heaters.

Figure 6:
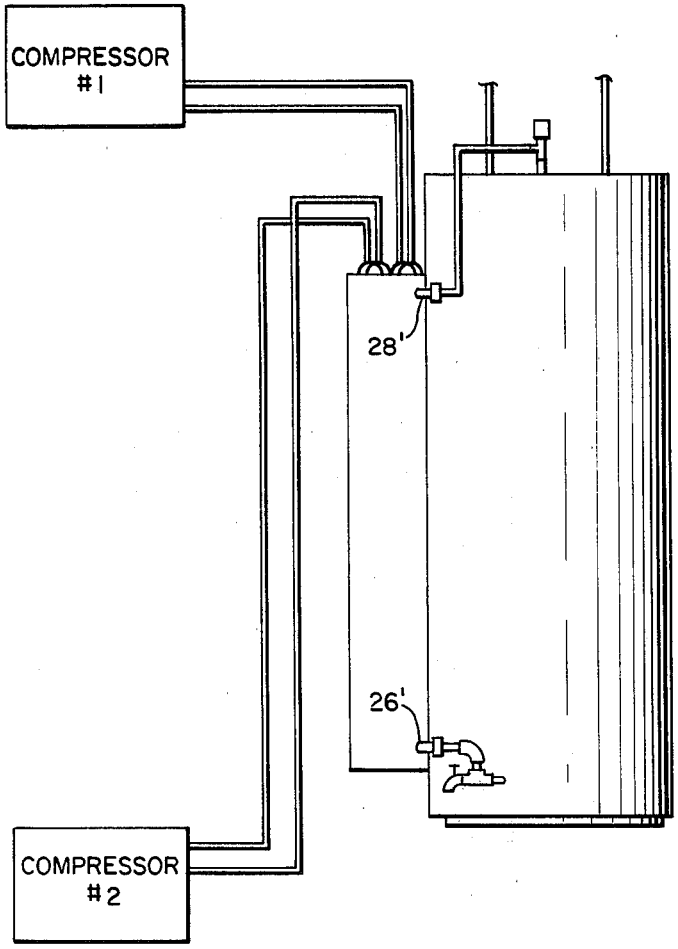
FIG. 6 is a modified embodiment showing a double element heat exchanger unit connected to double cooling compressors.
Figure 7:
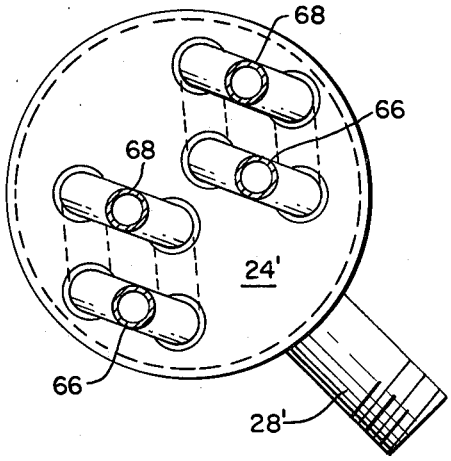
FIG. 7 is a top plan view of the double element heat exchanger unit per se as used in the arrangement of FIG. 6.

FIGS. 6 and 7 show a modified embodiment of the present invention wherein a double element heat exchanger unit is provided. With this double element type unit the outer casing 22' of the heat exchanger unit per se is constructed along the same lines as that of the unit shown in FIGS. 2–4. Similarly, the actual exchanger tubing with double-U end connecting structure is arranged like that of the preferred embodiment. However, in this modified embodiment, a double set of these exchanger tubing units are provided. Appropriate stub inlets 66 for the hot freon gases and stub outlets 68 for the heat extracted gases are provided. Of course, appropriate hot water inlets and outlets 26' and 28' are also provided.

The difference of this modified embodiment is that two air conditioner compressor refrigeration units 1 and 2, rather than just one, are employed. This would be used where in a residential house there are double air conditioning systems provided, or in the case of a commercial or business establishment, a walk-in type refrigeration unit may be hooked to one set of heat exchanger tubing and the air conditioning system for the entire building or portion of the building is used for the other input. Of course, by use of this double heat exchanger tubing unit, many more possibilities are available to the installer for converting the existing systems as already provided in most residential and/or commercial establishments. Also, when supplying this apparatus in kit form, it is possible to provide the double type unit, and if only a single refrigeration/air conditioning unit is available then only one set of heat exchanger tubings need be used, or both may be used in parallel with the single compressor/air conditioning compressor unit. Of course, appropriate piping or tubing in well known plumbing pipe fashion used to connect both inputs 66, and both of the two outputs 68 in parallel coupled relationship for maximum heat transfer of the hot refrigeration gases to the water being cycled through the hot water tank.

It should also be pointed out that a very important feature of the present invention is in the fact, as can be visualized by looking at FIGS. 1 and 5, that the water which has been heated by the conversion exchanger unit flows by convection to the existing hot water tank. Thus, no additional water pumps, or other additional transfer means are required for operation of this simple system. This, of course, means that the complete conversion kit is relatively inexpensive, and substantially lowers the cost over that of some of the known type prior art systems.

Figure 8:
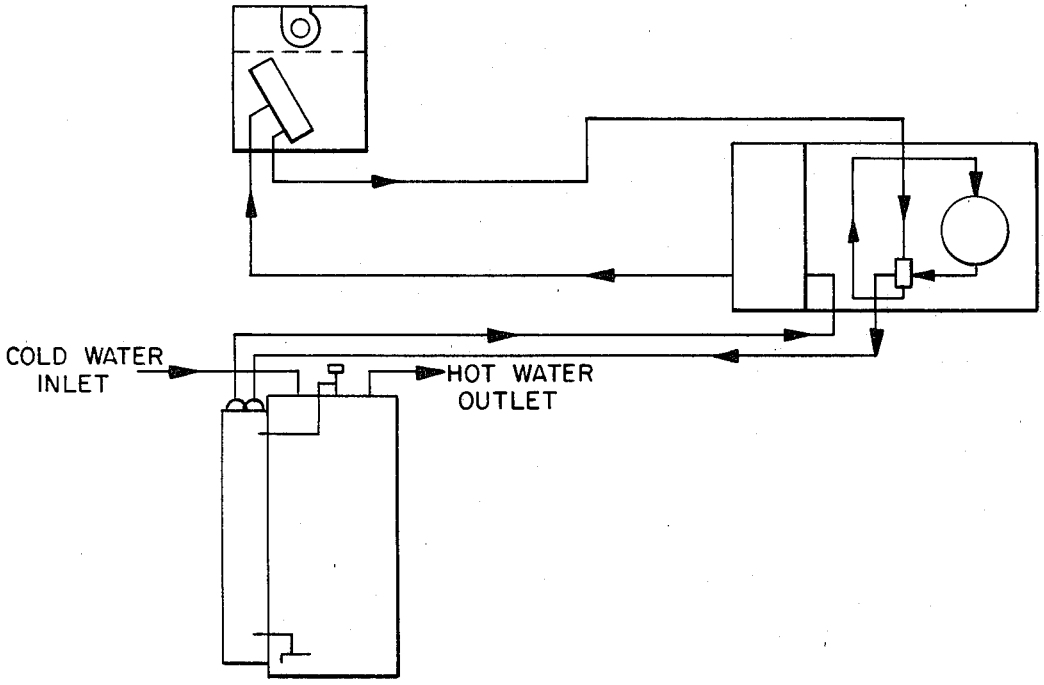
FIG. 8 is another embodiment of the present invention as used with a conventional type heat pump system and hot water heater with the heat pump switched to cooling.
Figure 9:
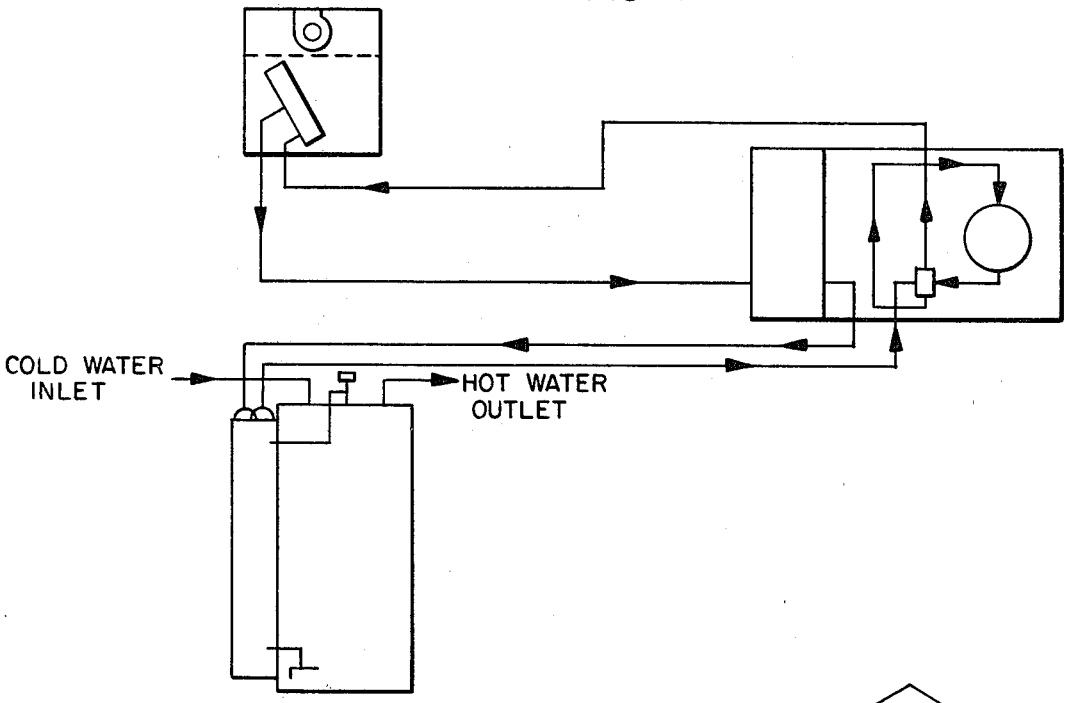
FIG. 9 shows the embodiment of FIG. 8, but with the heat pump switched to the heating cycle.

Looking at FIGS. 8 and 9, a further modified embodiment of the present invention is shown. In this embodiment, the conversion heat exchanger apparatus is connected to a heat pump type unit of the residential or commercial establishment. In this combination heating-/cooling type of hook-up, a four-way type valve must be present in the coupling tubing or piping in order that the appropriate switching take place when the heat pump is being used as an air conditioner, or when the heat pump is being used to heat the establishment. In known previous type conversion systems, the conversion unit is connected between the four-way valve and the compressor unit of the heat pump. In such a connection, it is necessary that the conversion unit be removed when the heat pump system is being used in the heating cycle, otherwise the heating thereof of the building will be substantially impaired. However, the inventor of the present invention has discovered that by connecting the heat exchanger conversion unit into the system between the four-way valve and the condensor unit, the conversion unit may be left connected up throughout the entire year, i.e. for both heating and cooling operation of the heat pump, and while working best during the use of the heat pump in the cooling configuration, will also function to some extent during the heating cycle thereof. FIG. 8 shows by the small flow arrows the flow of refrigerant gases during the cooling cycle while FIG. 9 shows a similar flow of these gases during the heating cycle. The saving of the otherwise wasted heat is equally effective in this type of conversion as in the ones already described.

Figure 10:
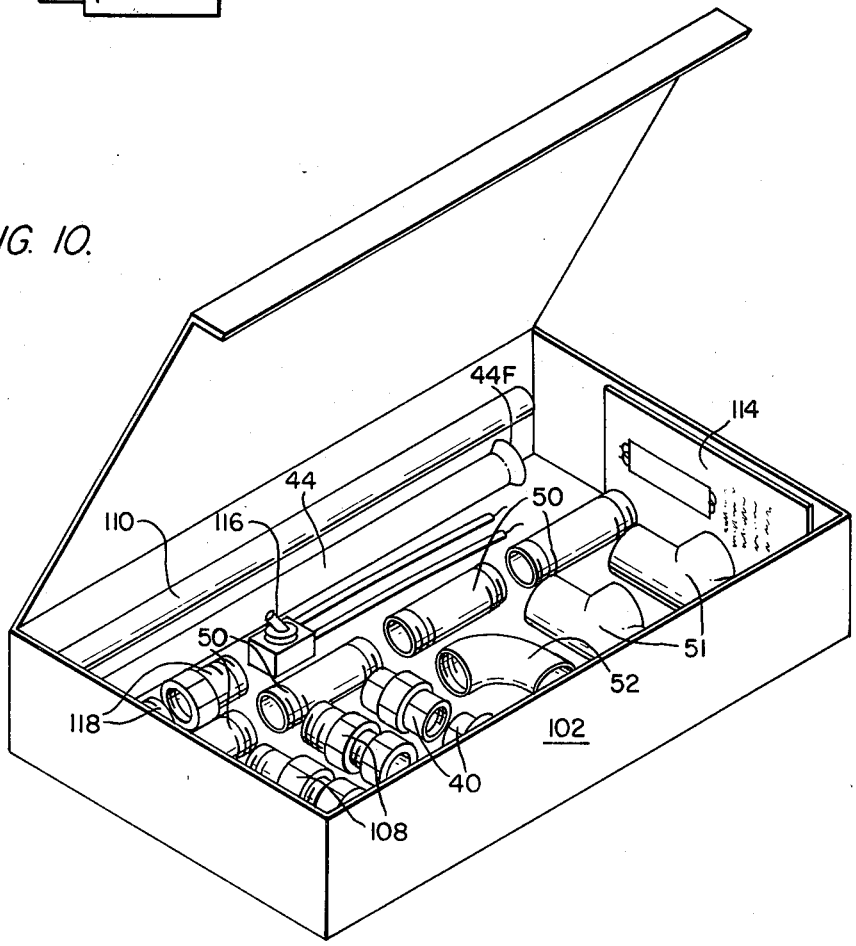
FIG. 10 is a view of the kit arrangement of the present invention complete with container, instruction booklet, and assorted hardware for installation of the heat exchanger unit supplied as a separate part, but along with the container and equipment as shown.

FIG. 10 shows the component elements as supplied in kit form consisting of the following items: a box or container 102 for holding the components; the extension tube 44 having one end flange 44F; at least one 110–120 volt AC on/off switch 116; at least four three-inch galvanized nipples 50; two galvanized Tee's 51; two galvanized unions 40; at least one galvanized elbow 52; at least one short piece of ½-inch copper tubing 110; two copper-to-galvanized tubing adaptors 108 with two compression fittings 111 and nuts 112 for copper tubing; several ¾-inch to ½-inch galvanized bushings 118; and an instruction booklet 114.

Along with the above structural components for attaching the heat exchanger unit to the hot water heater, the heat exchanger unit per se of either 36-inch or 48-inch length, and of either single or double heat exchange tubing construction, as well as the piece of insulation of fiberglass or the like for the covering of the exchanger unit, and the sheet metal cover 21 with attaching screws are included along with the container 102. Of course, if desired, the container 102 may be of sufficient length and size to hold the heat exchanger unit, sheet metal cover, and piece of insulation along with the components, but usually it is better to pack them separately.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method of saving energy which is otherwise usually wasted comprising;

providing a heat exchanger structure having at least one set of inlet/outlet lines for the flow of hot refrigeration gases therethrough and another set of inlet/outlet lines for the flow of liquid to be heated therethrough;

connecting said first set of inlet/outlet lines in series with a heating/cooling compressor-condensor system;

connecting said second set of inlet/outlet lines to an existing hot water tank and system without any pump therewith for the purpose aforesaid;

said second connecting step further including connecting the inlet line of said second set of inlet/outlet lines to the hot water heater at the conventional drain plug opening thereof;

and said inlet line connection of said second set of inlet/-outlet lines being made by plumbing elements having rigid structural strength for the purpose of supporting the heat exchanger structure physically from the drain plug opening of the hot water heater, and said outlet line connection of said second set of inlet/-outlet lines being made by plumbing elements having flexibility for making this connection with the maximum of ease and flexibility.

2. A method of saving energy which is otherwise usually wasted comprising;

providing a heat exchanger structure having at least one first set of inlet/outlet lines for the flow of hot refrigeration gases therethrough and another second set of inlet/outlet lines for the flow of liquid to be heated therethrough;

connecting said first set of inlet/outlet lines in series with a heating/cooling compressor-condensor system;

connecting said second set of inlet/outlet lines to an existing hot water tank and system without any pump in series therewith for the purpose aforesaid, said second connecting step including connecting the outlet line of said second set of inlet/outlet lines to the hot water heater at the conventional popoff valve opening thereof;

said hot water heater normally being energized by electricity and including both an upper and lower electric heating element;

the further additional step of adding an extension pipe of sufficient length at the popoff valve opening to force the inputted hot water from the heat exchanger structure to be discharged into the conventional hot water tank at a point below the upper heating element thereof.

3. The method of claim 2, wherein said second connecting step further includes connecting the inlet line of said second set of inlet/outlet lines to the hot water heater at the conventional drain plug opening thereof.

4. The method of claim 2, wherein said outline line connecting step to the popoff valve opening includes using plumbing elements which are partially flexible for ease of installation of the heat exchanger structure.

5. The method of claim 3, wherein said inlet line connecting step additionally includes, said inlet line connection being made by plumbing elements having rigid structural strength for the purpose of supporting the heat exchanger structure physically from the drain plug opening of the hot water heater.

* * * * *